US007847655B2

(12) United States Patent
Otani et al.

(10) Patent No.: US 7,847,655 B2
(45) Date of Patent: Dec. 7, 2010

(54) SWITCHING CIRCUIT

(75) Inventors: Norihisa Otani, Yokohama (JP); Eiichiro Otobe, Yokohama (JP)

(73) Assignee: Samsung Electro-Mechanics., Ltd., Suwon (KR)

( * ) Notice: Subject to any disclaimer, the term of this patent is extended or adjusted under 35 U.S.C. 154(b) by 200 days.

(21) Appl. No.: 12/180,870

(22) Filed: Jul. 28, 2008

(65) Prior Publication Data

US 2009/0033435 A1 Feb. 5, 2009

(30) Foreign Application Priority Data

Jul. 31, 2007 (JP) ..... 2007-199539

(51) Int. Cl.
*H01P 1/10* (2006.01)
*H01P 1/15* (2006.01)

(52) U.S. Cl. ..... 333/103; 333/101

(58) Field of Classification Search ..... 333/101, 333/103, 104, 105

See application file for complete search history.

(56) References Cited

U.S. PATENT DOCUMENTS 7,057,472 B2 6/2006 Fukamachi et al.
7,233,775 B2 * 6/2007 De Graauw ..... 455/78
7,589,602 B2 * 9/2009 Poveda et al. ..... 333/103
2005/0079829 A1 4/2005 Ogawa et al.

FOREIGN PATENT DOCUMENTS

| | | | |
|---|---|---|---|
| EP | 1418680 | A1 | 5/2004 |
| JP | 2003-318717 | A | 11/2003 |
| JP | 2005136948 | A | 5/2005 |
| JP | 2006-303775 | A | 11/2006 |

OTHER PUBLICATIONS

Korean Office Action for application No. 10-2008-0054325, issued on Feb. 22, 2010.

* cited by examiner

*Primary Examiner*—Dean O Takaoka
(74) *Attorney, Agent, or Firm*—Lowe Hauptman Ham & Berner LLP

(57) ABSTRACT

Disclosed is a switch circuit capable of reducing distortion caused by harmonics and preventing an increase in insertion loss even if the number of ports increases. The switching circuit includes one common output port, M first switches having one set of ends connected in common to a first node (M≧2 where M is a constant), N second switches having one set of ends connected in common to the common output port (N≧1 where N is a constant), a third switch having one end connected to the common output port and the other end connected to the first node, M first input ports respectively connected to the other set of ends of the first switches, and N second input ports respectively connected to the other set of ends of the second switches. One selected among the first input ports and the second input ports is connected to the common output port, and if one of the first input ports is selected, the third switch is closed.

7 Claims, 14 Drawing Sheets

SWITCHING CIRCUIT

CROSS-REFERENCE TO RELATED APPLICATIONS

This application claims the priority of Japanese Patent Application No. 2007-199539 filed on Jul. 31, 2007, in the Japanese Intellectual Property Office, the disclosure of which is incorporated herein by reference.

BACKGROUND OF THE INVENTION

1. Field of the Invention

The present invention relates to a switching circuit, and more particularly, to a radio frequency (RF) switching circuit used in transmit-receive switching of wireless communication devices such as multi-band/multi-mode portable terminals used in a sub-microwave band or a microwave band.

2. Description of the Related Art

Research or development is actively ongoing on products such as multi-band/multi-mode mobile terminals. Particularly, global system for mobile communication (GSM) 4band mobile terminals are being actively developed. A new universal mobile telecommunications system (UMTS) mode is also added to realize better multi-band performance. Also, a switching circuit employing a small, high-performance single-pole/multi-throw (SPMT) switch capable of transmit-receive switching is demanded, as well as the multi-band performance of using transmission schemes of different frequency bands. The SPMT switching circuit is strongly required to reduce harmonic distortion and insertion loss.

FIGS. 2A and 2B are diagrams of a related art switching circuit, illustrating switching of a transmission part. FIG. 2A is a basic conceptual diagram, and FIG. 2B is an equivalent circuit diagram. A switching circuit in FIGS. 2A and 2B is an SP5T type switching circuit. In general, an antenna is connected to a common port, and switching is made such that one of port1 to port5 is selectively connected to the common port. In general, a high-power signal is supplied to the port1 and the port2, and a low-power signal is supplied to the port3 to the port5. As shown in FIG. 2A, input (I) terminals 1 to 5 of the port1 to the port5 are connected with power amplifiers 1 to 5, respectively. Switches for connecting any one port to the common port connected with the antenna include switches SW1 to SW5, and complementary switches $\overline{\text{SW1}}$ to $\overline{\text{SW5}}$.

An example of FIG. 2B illustrates a state in which the port1 to which a high-power signal is connected is connected to the common port. In the following description, the common port is referred to as a common output port, the port3 to the port5 are referred to as first input ports, and the port1 and the port2 are referred to as second input ports. Here, if the port1 which is one of the second input ports is connected to the common output port, a transmission signal is input to the port1 through the amplifier 1 from the I terminal 1, and this signal is output from the common output terminal. At this time, an output signal from the antenna contains harmonics because distortion components caused at the switch SW1 in an ON state and distortion components caused at the switches SW2 to SW5 in an OFF state are also output to the antenna. In general, the switches SW1 to SW5 and the switches $\overline{\text{SW1}}$ to $\overline{\text{SW5}}$ each include a semiconductor circuit, i.e., a field effect transistor (FET). In general, when the switches including the FETs are turned ON or OFF, signal distortion occurs, generating harmonics.

In the example of FIGS. 2A and 2B, there are four switches being in an OFF state and connected with the antenna via the common output port. As ports increase in number, the harmonic distortion increases.

FIG. 3 is a graph showing relation between the number of branches in an OFF state and signal degradation caused by the harmonics. As can be seen from FIG. 3, the signal degradation resulting from the harmonics increases with an increase in the number of branches in an OFF state. Japanese Patent Laid-Open Publication Nos. 2003-318717 and 2006-303775 disclose related art techniques for reducing insertion loss and harmonic distortion of an RF switching circuit.

The invention disclosed in Japanese Patent Laid-Open Publication No. 2003-318717 removes a specific frequency component by using a series resonant circuit and a transistor connected to the series resonant circuit, thereby compensating for resonance caused in an OFF state of the transistor.

Also, the invention disclosed in Japanese Patent Laid-Open Publication No. 2006-303775 changes a phase of a voltage applied to capacitance between a gate and a source of an FET constituting a switch and capacitance between a gate and a drain, thereby reducing the harmonic-distortion rate.

However, the inventions fail to sufficiently reduce the harmonic distortion or insertion loss with respect to an increase in the number of ports.

SUMMARY OF THE INVENTION

An aspect of the present invention provides a switching circuit capable of reducing distortion caused by an influence of harmonics and reducing insertion loss even if the number of ports of the switching circuit increases.

According to an aspect of the present invention, there is provided a switching circuit including: one common output port; M first switches having one set of ends connected in common to a first node, wherein $M \geqq 2$ where M is a constant; N second switches having one set of ends connected in common to the common output port, wherein $N \geqq 1$ where N is a constant; a third switch having one end connected to the common output port and the other end connected to the first node; M first input ports respectively connected to the other set of ends of the first switches; and N second input ports respectively connected to the other set of ends of the second switches. One selected among the first input ports and the second input ports is connected to the common output port. If one of the first input ports is selected, the third switch is closed.

Power of a frequency signal input to the second input port may be higher than power of a frequency signal input to the first input port by at least 3 dB.

According to another aspect of the present invention, there is provided a switching circuit including: one common output port; M first switches having one set of ends connected in common to a first node, wherein $M \geqq 2$ where M is a constant; N second switches having one set of ends connected in common to the common output port, wherein $N \geqq 1$ where N is a constant; a third switch having one end connected to the common output port or the first node through a jumper wire and the other end connected to the first node or the common output port; M first input ports respectively connected to the other set of ends of the first switches; and N second input ports respectively connected to the other set of ends of the second switches, wherein one selected among the first input ports and the second input ports is connected to the common output port, and if one of the first input ports is selected, the third switch is closed.

A length of the jumper wire may be determined such that if one of the second input ports is selected, a resonant frequency caused by capacitance formed at the M first switches being open and inductance of the jumper wire becomes equal to a harmonic of a frequency signal applied to the selected second input port.

A harmonic of a frequency signal applied to one of the second input ports may be at least 2.5 times higher than the highest frequency of frequency signals applied to another port.

The first to third switches may each include a field effect transistor.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
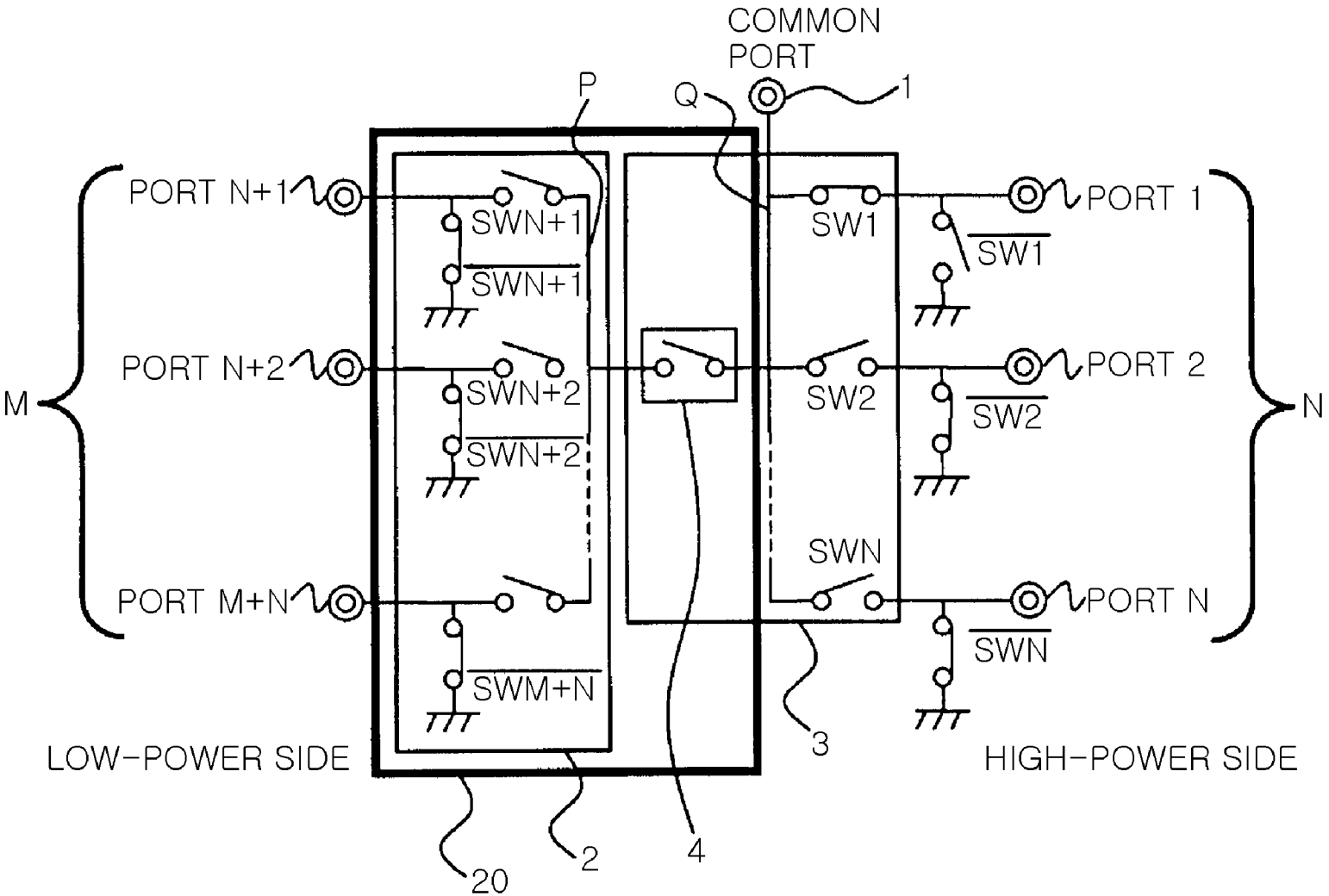
FIG. 1 is a circuit diagram of a switching circuit according to an exemplary embodiment of the present invention.

FIG. 1 is a circuit diagram of a switching circuit according to an exemplary embodiment of the present invention. Referring to FIG. 1, the switching circuit according to the current embodiment includes a common port 1 which is one common output port, N ports port1, port2, . . . and portN ($N \geqq 1$ where N is a constant) connected to an input terminal of a high-power side, and M ports portN+1, portN+2, . . . and portM+N ($M \geqq 2$ where M is a constant) connected to an input terminal of a low-power side. The ports portN+1, portN+2, . . . and portM+N of the low-power side are respectively connected in common to a first node P through switches SWN+1, SWN+2, . . . and SWM+N. Also, the ports port1, port2, . . . and portN of the high-power side are respectively connected in common to a second node Q through switches SW1, SW2, . . . SWN. The switches SW1, SW2, . . . SWN, SWN+1, SWN+2, . . . and SWM+N may be configured as complementary switches. In this case, each of those complementary switches $\overline{\text{SW1}}$, SW2, . . . $\overline{\text{SWN}}$, $\overline{\text{SWN+1}}$, $\overline{\text{SWN+2}}$, . . . and $\overline{\text{SWM+N}}$ may be connected between corresponding one of the ports and a ground point, as shown in FIG. 1. In the description below, the switches SWN+1, SWN+2, . . . and SWM+N connected to the respective ports of the low-power side are referred to as first switches. Also, the switches SW1, SW2, . . . and SWN connected to the respective ports of the high-power side are referred to as second switches. According to the current embodiment, a third switch 4 is installed between the first node P and the second node Q. The third switch 4 is controlled to be closed only when any one of the ports of the low-power side is connected to the common output port 1.

Figure 2A:
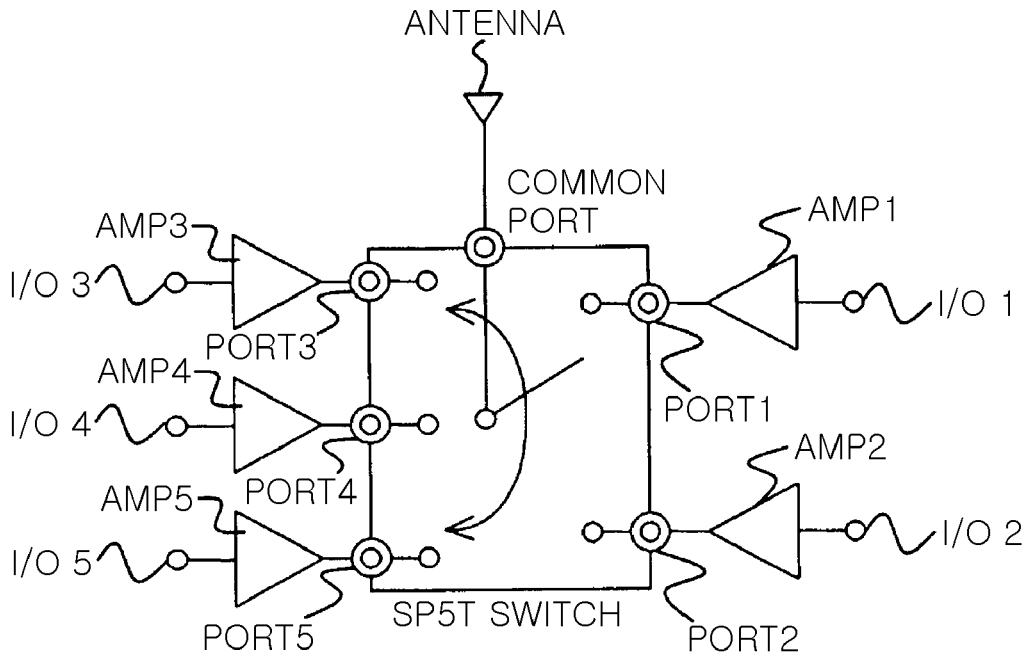
PRIOR ART FIG. 2A
FIG. 2A is a basic conceptual view of a related art switching circuit.
Figure 2B:
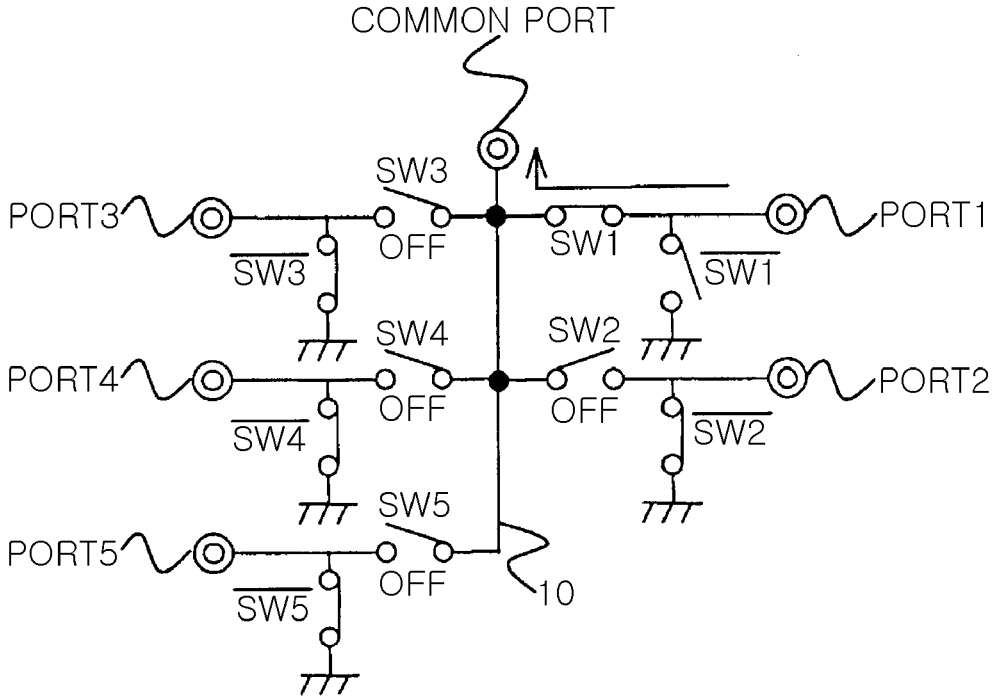
PRIOR ART FIG. 2B
FIG. 2B is an equivalent circuit diagram of the related art switching circuit of FIG. 2A.

The switching circuit according to the current embodiment is different from the related art switching circuit of FIG. 2 in terms of a configuration of a circuit part 20 indicated by a thicker sold line in FIG. 1. In detail, referring to FIG. 1, a portion 2 of the circuit part 20 has the same configuration as the related art switching circuit, but a portion 3 of the circuit part 20 has a different configuration. That is, one end of the third switch 4 is connected to the second node Q, and the other end of the third switch 4 is connected to the first node P. Here, the second node Q is connected to the common output port 1 and to one set of respective ends of the switches SW1, SW2, . . . and SWN, and the first node P is connected to the switches SWN+1, SWN+2, . . . and SWM+N of the low-power side. A semiconductor field effect transistor may be used for the third switch 4 like other switches.

Figure 4A:
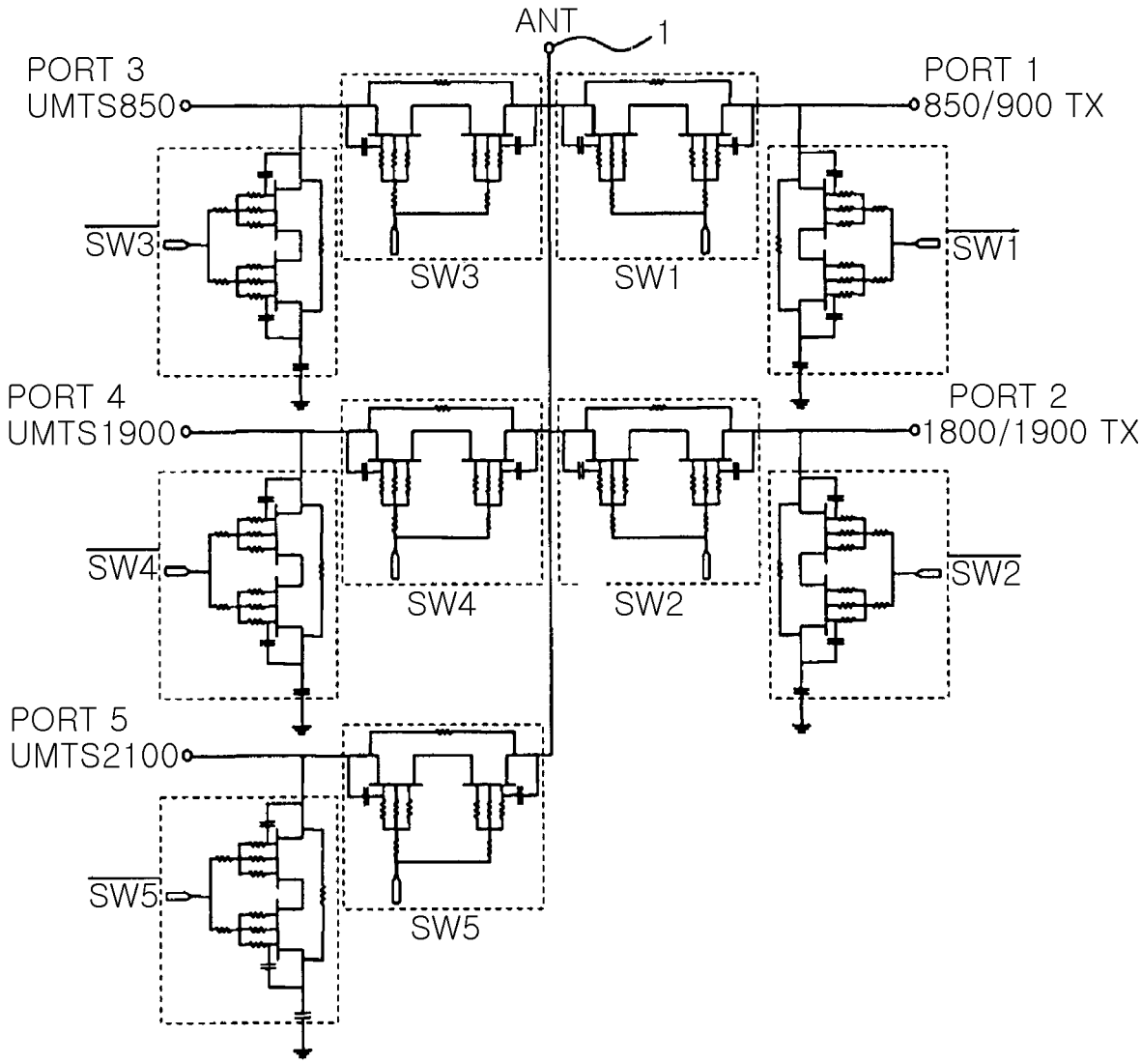
FIG. 4A is a circuit diagram of a related art switching circuit.
Figure 4B:
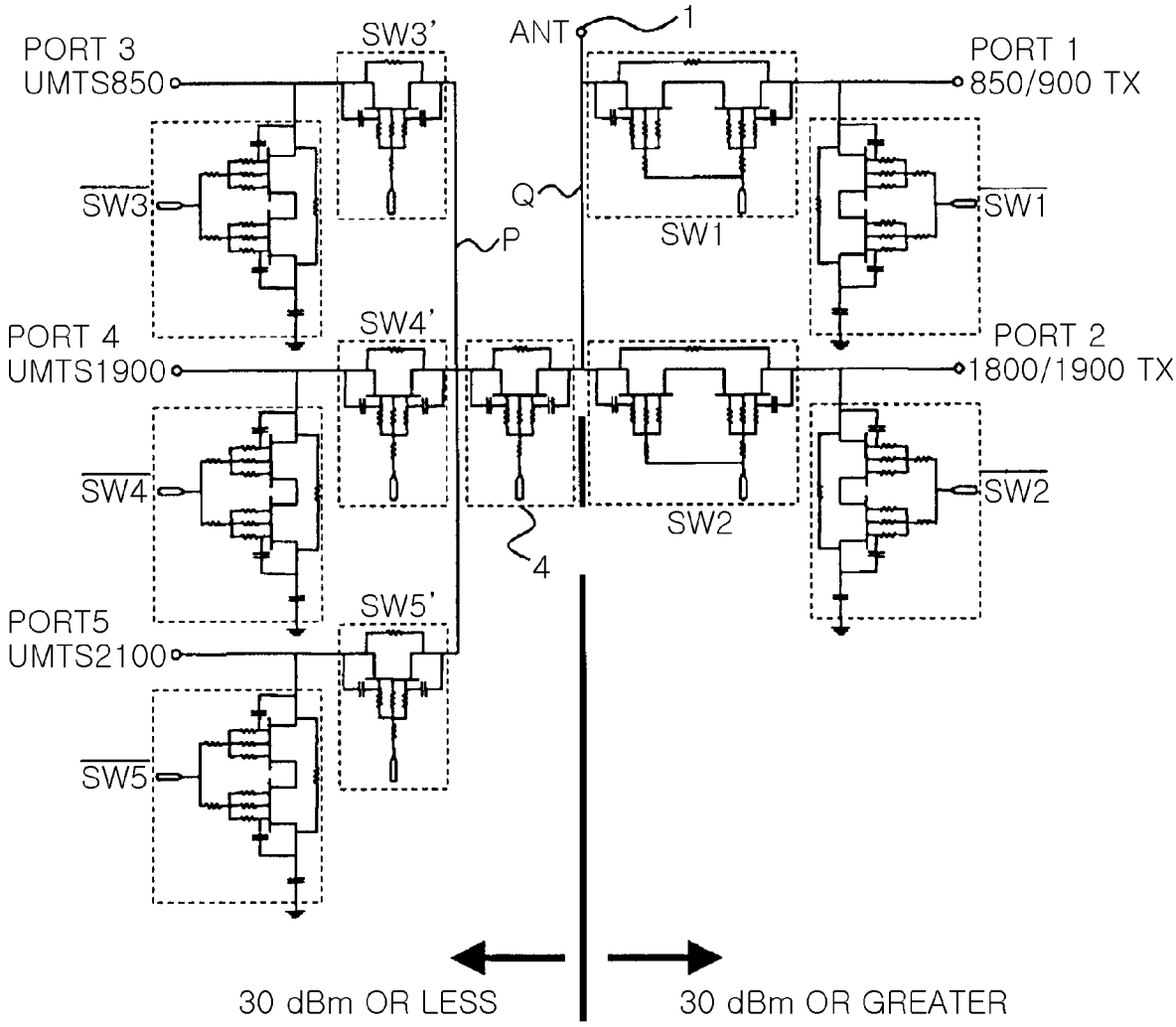
FIG. 4B is a circuit diagram of a switching circuit according to the exemplary embodiment of the present invention.

FIGS. 4A and 4B are circuit diagrams of a related art switching circuit and a switching circuit according to the exemplary embodiment of the present invention, respectively. Each of the switching circuits of FIGS. 4A and 4B has switch branches of three ports at a high-power side and three ports at a low-power side. Semiconductor field effect transistor (FET) switches are used in each of the switching circuits of FIGS. 4A and 4B. In FIGS. 4A and 4B, switches SW1 to SW5 and switches $\overline{\text{SW1}}$ to $\overline{\text{SW5}}$ correspond to the switches illustrated in FIG. 1 or 2. As shown in FIG. 4A, the switches SW1 to SW5 and the switches $\overline{\text{SW1}}$ to $\overline{\text{SW5}}$ each have a configuration in which two FETs are connected together in series and simultaneously turned ON/OFF.

As shown in FIG. 4B, in the switching circuit according to the current embodiment, each of switches SW3', SW4' and SW5' includes only one FET as compared to the related art switching circuit in which two FETs constitute each of the switches SW3 to SW5. The third switch 4 also includes one FET. Accordingly, in the case of the switching circuit according to the current embodiment, the number of FETs being used in a switch can be reduced, thereby contributing to miniaturization of a switching circuit. In general, 850/900TX is connected the port1, 1800/1900TX is connected to the port2, UNTS850 is connected to the port3, UMTS1900 is connected to the port4, and UMTS2100 is connected to the port5. A signal handling level at the port1 and the port2 of the high-power side is 3 dBm or greater, and a power handling level at the port3 to port5 of the low-power side is 30 dBm or less. In the configuration as described above, harmonic characteristics do not degrade as compared to the related art even when one port of the low-power side is in connection with the common port 1 or one port of the high-power side is in connection with the common port 1.

Figure 5A:
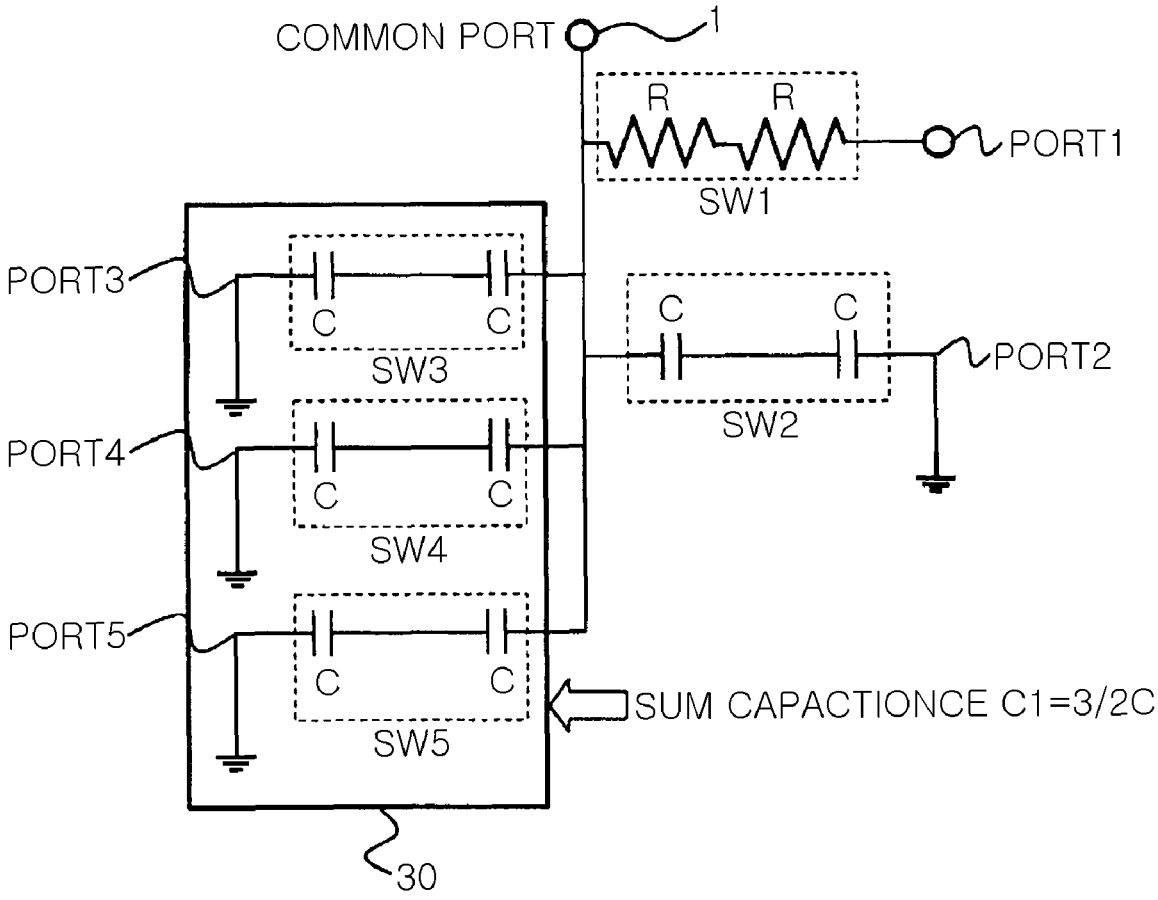
FIG. 5A is an equivalent circuit diagram of the related art switching circuit of FIG. 4A.
Figure 5B:
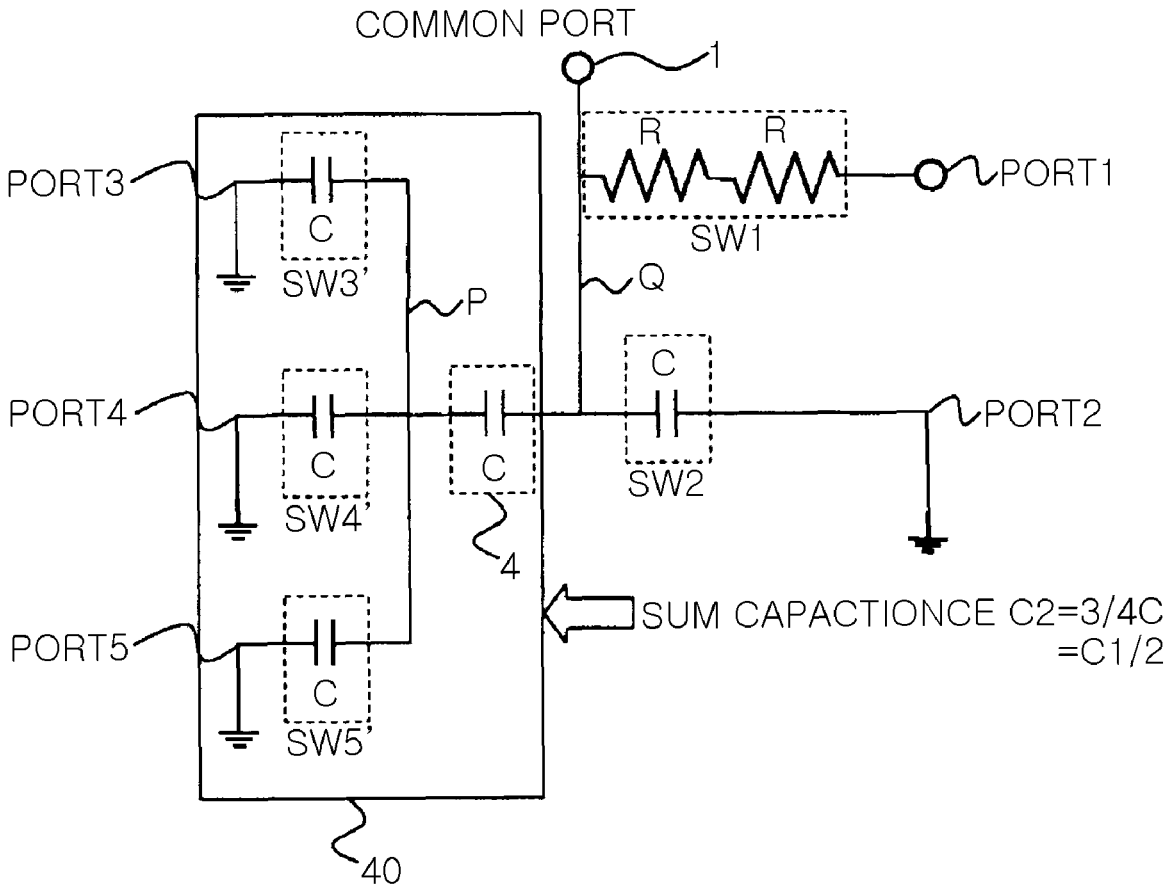
FIG. 5B is an equivalent circuit diagram of the switching circuit of FIG. 4B.

FIGS. 5A and 5B are equivalent circuit diagrams of the switching circuits in the case where the port1 of the high-power side and the common port 1 are in an ON state. FIG. 5A corresponds to FIG. 4A, and FIG. 5B corresponds to FIG. 4B. In an example of each of FIGS. 5A and 5B, the port1 is connected with the common port 1 which is a common output port, and other ports are in an open state by turning off the respective corresponding switches. Since the port1 is connected to the common port 1, two FETs constituting the switch SW1 are turned ON and are illustrated equivalently as internal resistance R. Other switches are all in an OFF state and are illustrated as OFF-capacitance C.

The insertion loss of the switching circuit according to the current embodiment will now be described in comparison with the related art switching circuit. The configuration of the ports of the high-power side viewed from the common port 1 of the switching circuit of FIG. 5B is identical to that of FIG. 5A. Therefore, description will be made on the sum capacitance connected to the common port 1 in the case of the ports of the low-power side viewed from the common port 1. First, the sum capacitance C1 of a circuit part 30 of the low-power side of the related art switching circuit of FIG. 5A is 3/2 C. In comparison, the sum capacitance C2 of a circuit part 40 of the low-power side of the switching circuit of FIG. 5B is 3/4 c, which is half the capacitance C1 of the circuit part 30 of FIG. 5A. Accordingly, the impedance of the circuit part 40 of the switching circuit of FIG. 5B is higher than that of the circuit part 30 of the switching circuit of FIG. 5A, and the insertion loss is smaller in the switching circuit of FIG. 5B than in the related art switching circuit of FIG. 5A. Also, in the switching circuit according to the current embodiment, the number of FETs being in an OFF state and connected to the antenna via the common port 1 is two equivalently. That is, the substantial configuration of the switching circuit according to the current embodiment is an SP5T type configuration, but the number of FETs in an OFF state is two, which is equivalently the same as the number of FETs in an OFF state in the case of a related art SP3T type switching circuit. This means that according to the current embodiment, the harmonic distortion is the same as that in the related art SP3T type switching circuit, and is reduced as compared to the related art SP5T type switching circuit. The same effects can be achieved even in the 1800/19000TX mode using the port2.

Description will now be made on a universal mobile telecommunication system (UMTS) mode using a port of the low-power side. In this case, harmonic characteristics are the same as those in the related art SP5T type switching circuit. For example, in a UMTS850 mode, two FETs of the switch SW3 connected together in series between the port3 and the common port 1 are turned ON, and two FETs connected in series in each of other switches are turned OFF. At this time, the number of FETs being in an OFF state and affecting the harmonics is four, which is the same as in the related art SP5T type switching circuit. Accordingly, the harmonic characteristics do not degrade. Also, although a gate of each of the FETs being in an OFF state and connected in series in the UMTS mode is a triple gate as shown in FIG. 4B, sufficient harmonic characteristics can be obtained even with the triple gate because of low transmission power. For example, if the gate has a triple gate structure, a gate length (Wg) is 125 um and the number of fingers is twenty, a value of the capacitance (C) caused by an equivalent circuit of a switch capacitance of the switch in FIG. 5B is approximately 0.3 pF. Also, according to the current embodiment, the insertion loss slightly increases in the UMTS mode, but the load of power amplifiers connected to the port1 or port2 of the high-power side is decreased. Consequently, DC power consumption is reduced on the whole.

Figure 3:
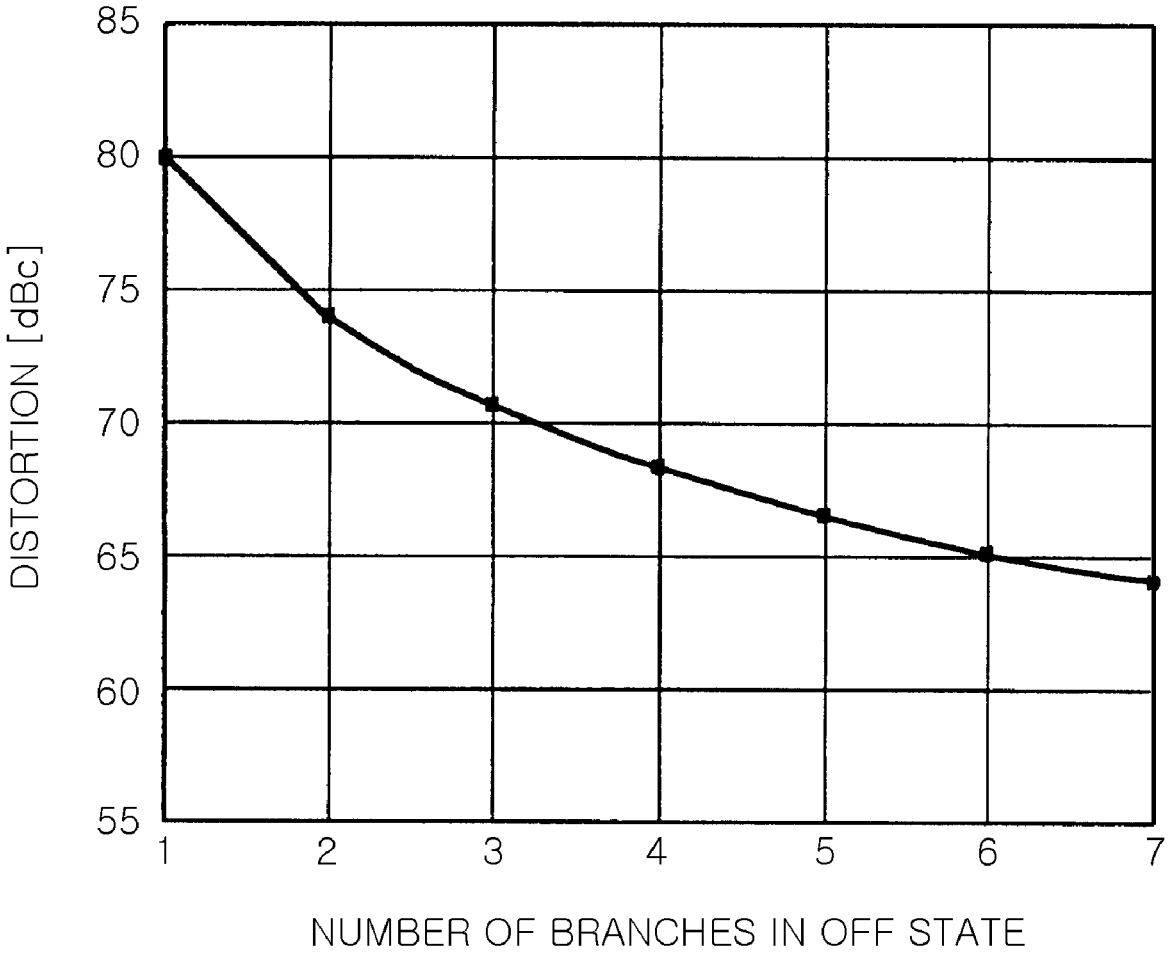
PRIOR ART FIG. 3
FIG. 3 is a characteristic graph showing relation between the number of branches in an OFF state and signal degradation caused by harmonics.
Figure 6:
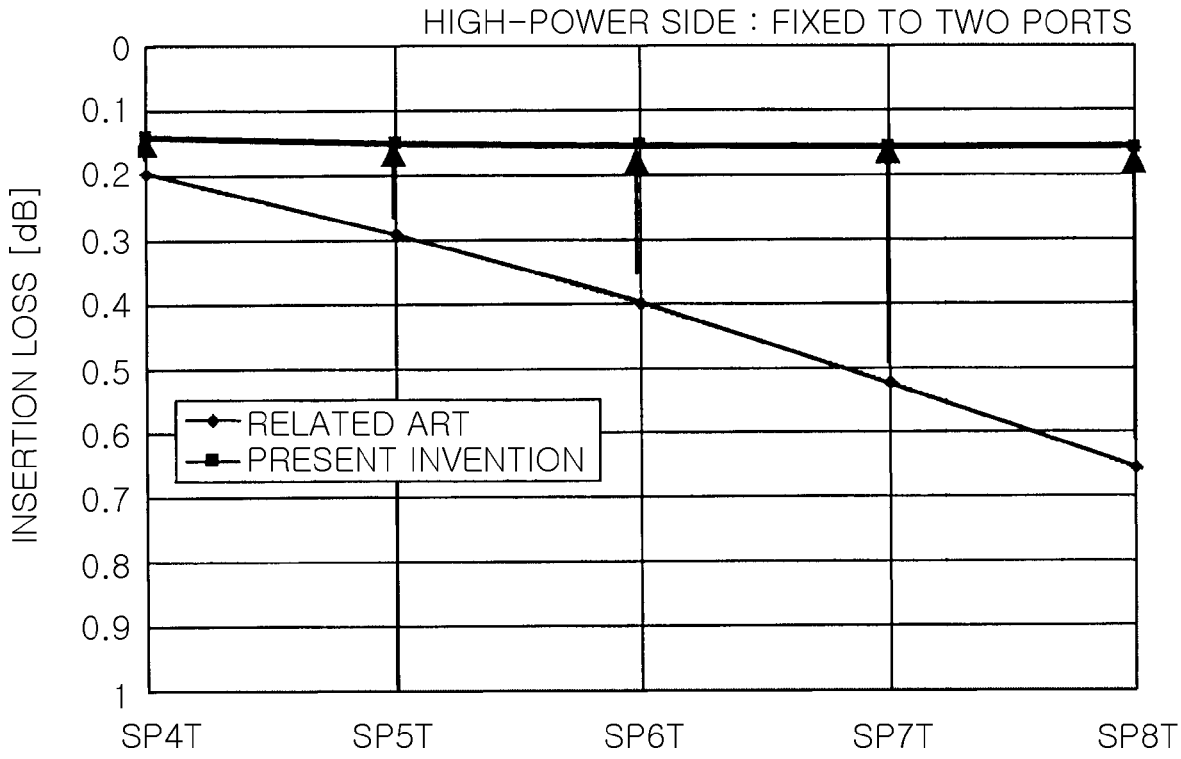
FIG. 6 is a characteristic graph showing insertion loss with respect to an increase in number of switches of a switching circuit in the case where the number of ports at a high-power side is fixed to two and the number of ports at a low-power side is increased.

FIG. 6 is a graph showing insertion loss with respect to an increase in number of switches in the case where the number of ports at a high-power side is fixed to two and the number of ports at a low-power side is increased. As can be seen from FIG. 6, in the related art switching circuit, the insertion loss increases with an increase in number of branches of a switching circuit. However, in the switching circuit according to the current embodiment present invention, the insertion loss is almost constant even if branches increase in number. Of course, the harmonic distortion also decreases as can be seen even from the characteristic graph of FIG. 3 showing the harmonic distortion with respect to the number of branches being in an OFF state and connected to the common port 1. Referring to FIGS. 2A and 2B and FIGS. 4A and 4B, there are four branches in an OFF state in the related art switching circuit, and thus the harmonic distortion is 68 dBc, whereas there are two equivalent branches in an OFF state in the switching circuit according to the current embodiment, and thus the harmonic distortion is 74 dBc. Accordingly, the harmonic characteristics can be improved by about 6 dB.

Figure 7:
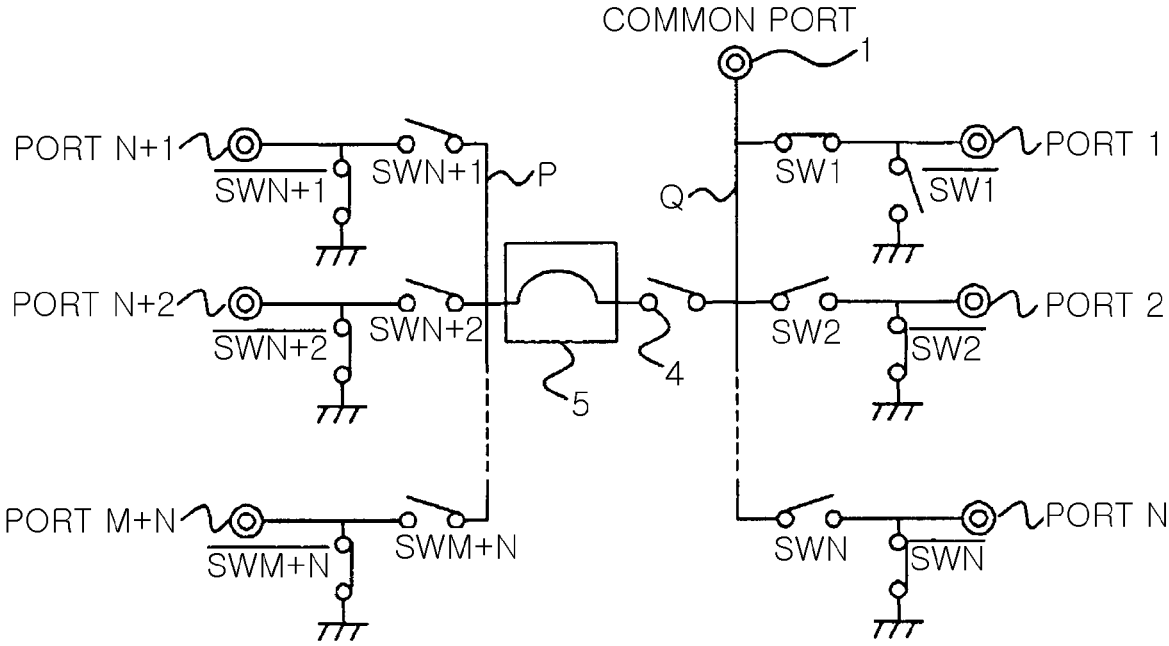
FIG. 7 is a circuit diagram of a switching circuit according to another exemplary embodiment of the present invention.

A second exemplary embodiment of the present invention will now be described. To reduce an influence of a third harmonic in the 1800/1900TX mode, a jumper wire 5 may be added as shown in FIG. 7. That is, one end of the jumper wire 5 is connected to one end of the third switch 4, and the other end of the jumper wire 5 is connected to the first node P. That is, the first node P and the second node Q are connected together by connecting the third switch 4 with the jumper wire 5 in series. The jumper wire 5 may be connected between the third switch 4 and the common output port 1. The jumper wire 5 is not limited to the description and any inductance member such as an inductor or a bonding wire may be used for the jumper wire 5.

Figure 8A:
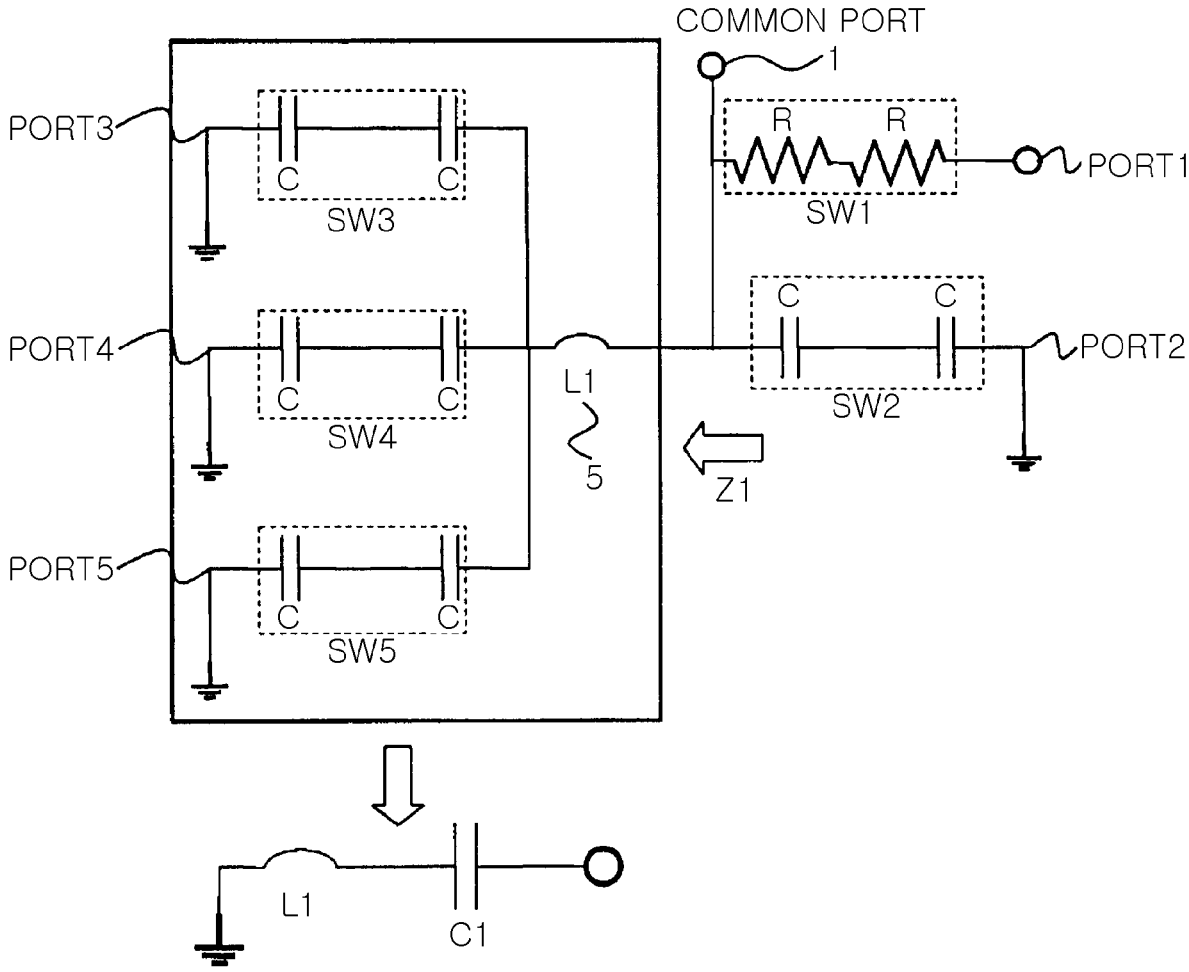
FIG. 8A is an equivalent circuit diagram of a related switching circuit further including a jumper wire.
Figure 8B:
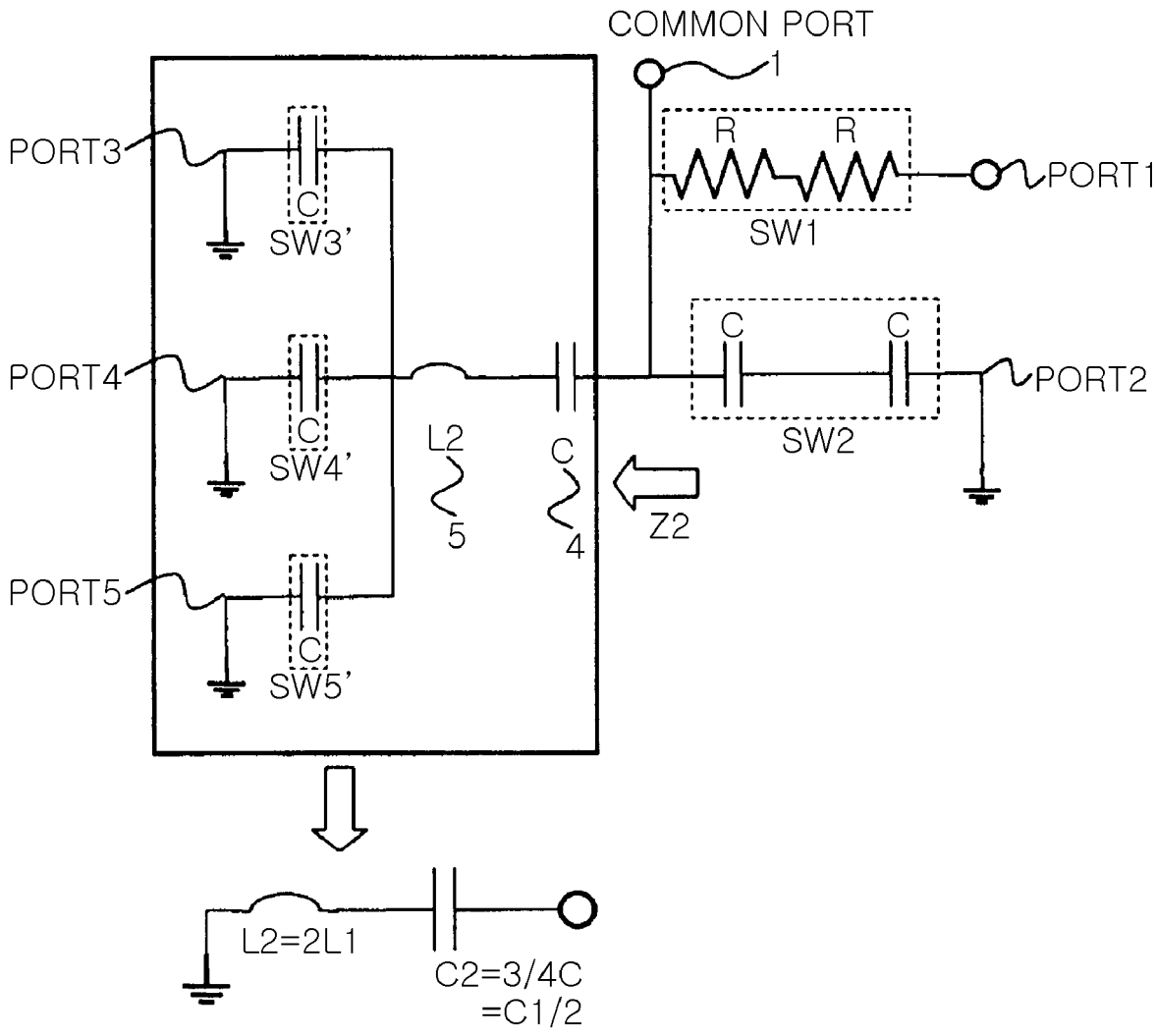
FIG. 8B is an equivalent circuit diagram of a switching circuit further including a jumper wire, according to the exemplary embodiment of the present invention.

FIG. 8A is an equivalent circuit diagram illustrating a related art switching circuit further including the jumper wire 5. FIG. 8B is an equivalent circuit diagram illustrating a switching circuit further including the jumper wire 5, according to another exemplary embodiment of the present invention. FIGS. 8A and 8B illustrate a state in which the port1 of the high-power side and the common port 1 are in an ON state. Referring to FIG. 8A, the impedance Z1 of the ports of the low-power side viewed from the common port 1 is equal to a series-connection value of the sum capacitance C1 and the inductance C1 of the jumper wire 5. In comparison, in the switching circuit according to the current embodiment, the impedance Z2 of the ports of the low-power side is equal to a series-connection value of the inductance L2 of the jumper wire 5 and the sum capacitance C2. If resonance frequencies in circuits formed by the inductance of the jumper wire and the sum capacitance are the same in FIGS. 8A and 8B, the inductance L2 of the jumper wire 5 used in the switching circuit according to the current embodiment is 2L1 because C2=C1/2 as mentioned above. Also, a resonant frequency of a circuit formed by the inductance of the jumper wire 5 and the sum capacitance C2 needs to be equal to harmonics of an operating frequency connected to the ports of the high-power side. Therefore, the generated harmonics are trapped and prevented from being output from the common port 1. Also, if a switching circuit including such a trap circuit is used, harmonics of an operating frequency signal applied to one of the ports of the high-power side need to be about 2.5 times higher than the highest frequency of an operating frequency signal applied to another port of the high-power side. For example, a length of the jumper wire 5 is controlled such that the jumper wire 5 resonates at a frequency three times higher than a band of 1800/1900TX, thereby suppressing the generated third harmonic. Also, according to the current embodiment, the jumper wire 5 has a small influence on the insertion loss in the 850/900TX mode and the 1800/1900TX mode because the impedance of a resonance circuit is higher than that in the related art switching circuit as shown in FIGS. 8A and 8B.

Figure 9:
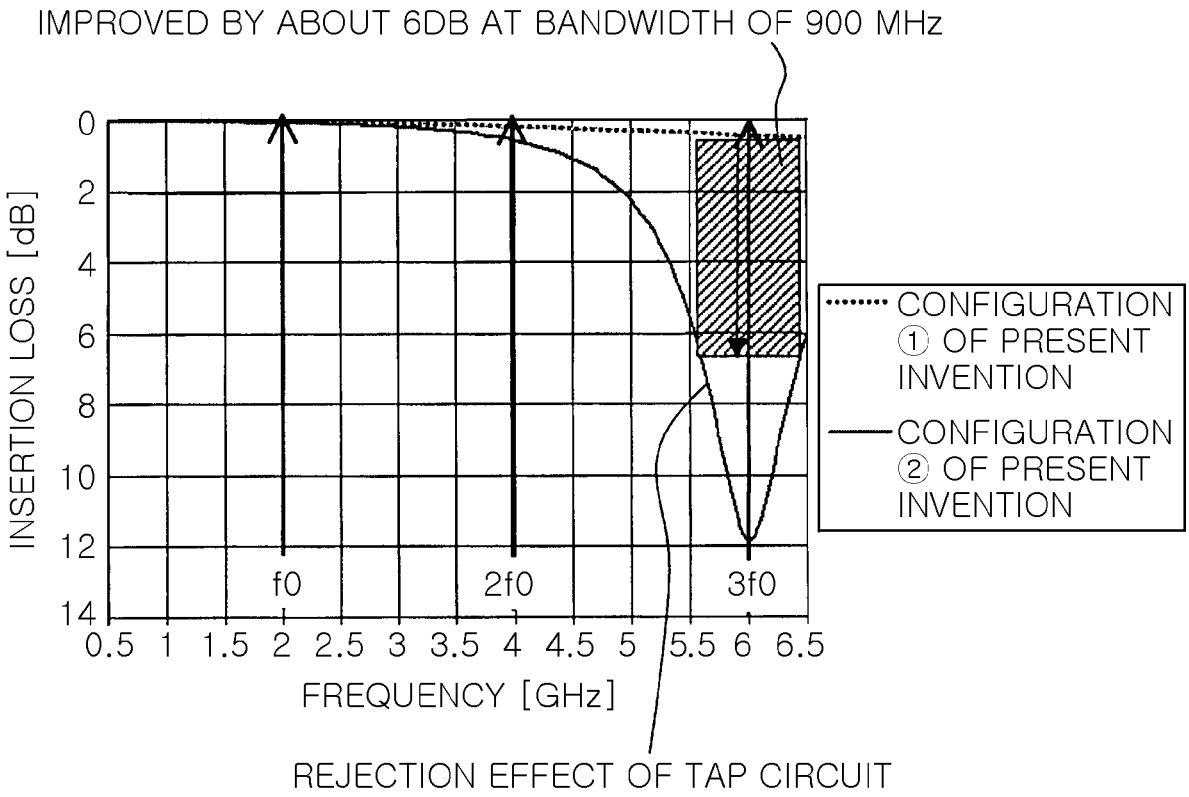
FIG. 9 is a characteristic graph showing an insertion characteristic of harmonics when a trap circuit is formed by using a jumper wire.

FIG. 9 is a view showing an insertion characteristic of harmonics when a trap circuit is formed by using the jumper wire. When an operating frequency fo is 2 GHz, a configuration 2 of the present invention using the jumper wire improves characteristics of the third harmonics 3fo by about 6 dB in a bandwidth of 900 MHz. Also, in the case of a configuration 1 of the present invention without the jumper wire, there is almost no change in insertion loss at the third harmonics 3fo because the trap circuit is not formed.

Figure 10:
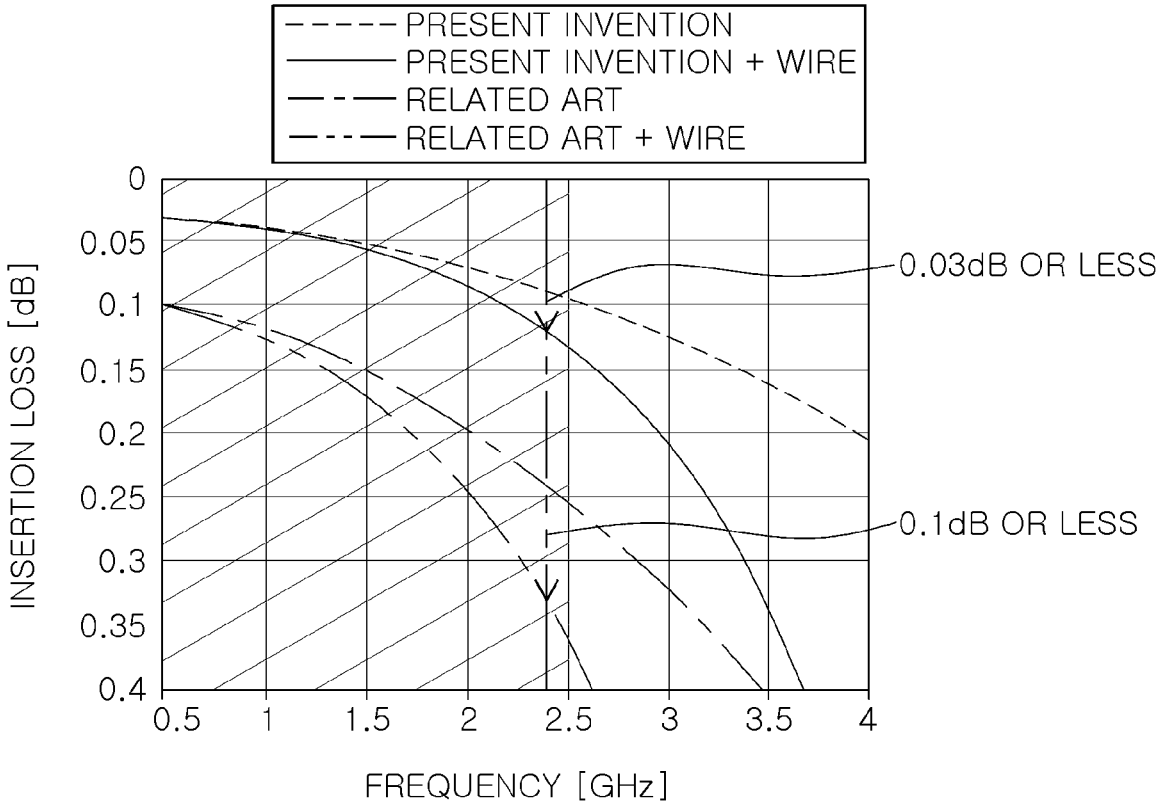
FIG. 10 is a characteristic graph showing insertion loss of a related art switching circuit, a related art switching circuit further including a jumper wire, a switching circuit further including a third switch according to the present invention, and a switching circuit further including a third switch and a jumper wire according to the present invention.

FIG. 10 is a characteristic graph showing insertion loss of a related art switching circuit, a related art switching circuit further including a jumper wire, a switching circuit further including a third switch according to the present invention, and a switching circuit further including a third switch and a jumper wire according to the present invention. As can be seen from FIG. 10, in the related art switching circuit further including the jumper wire, the insertion loss increases by about 0.1 dB. However, according to the present invention, the insertion loss increases by only about 0.03 dB even if the jumper wire is added. Thus, according to the present invention, an influence of the jumper wire on the insertion loss is smaller than in the related art switching circuit. This is because the impedance of a resonance circuit formed by the sum capacitance at branches of the low-power side and the inductance of the jumper wire is higher than an impedance of the related art switching circuit further including the jumper wire.

Figure 11:
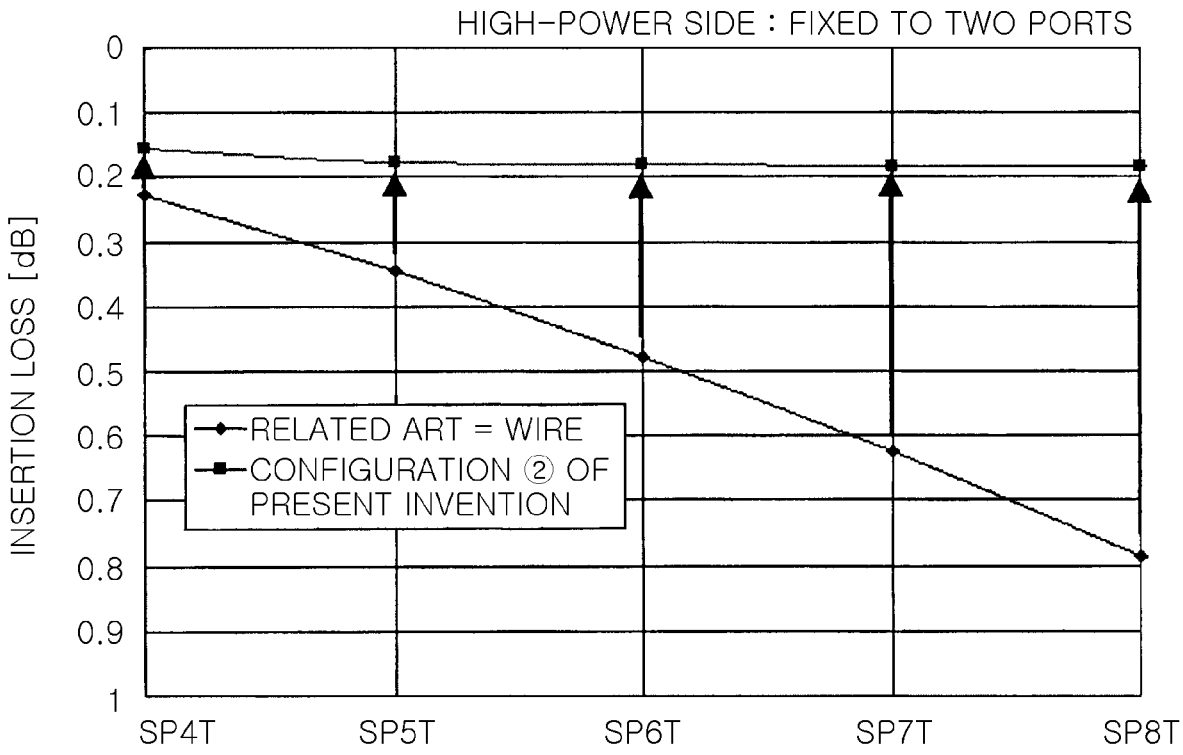
FIG. 11 is a characteristic graph showing insertion loss with respect to an increase in number of branches in a related art switching circuit further including a jumper wire, and a switching circuit further including a jumper wire according to the present invention.

FIG. 11 is a characteristic graph showing insertion loss with respect to an increase in number of branches in a related art switching circuit further including a jumper wire, and a switching circuit further including a jumper wire according to the present invention. The number of ports at the high-power side is fixed to two. As can be seen from FIG. 11, according to the present invention, the insertion loss does not increase, regardless of an increase in number of branches despite the jumper wire added to the switching circuit.

According to the present invention, since the number of switches being in an OFF state and connected with the common output port is set equivalently to two, a switching circuit can be configured without increasing an influence on harmonics or insertion loss even if the number of ports is increased.

While the present invention has been shown and described in connection with the exemplary embodiments, it will be apparent to those skilled in the art that modifications and variations can be made without departing from the spirit and scope of the invention as defined by the appended claims.

What is claimed is:

1. A switching circuit comprising:

one common output port;

M first switches having one set of ends connected in common to a first node, wherein M≧2 where M is a constant;

N second switches having one set of ends connected in common to the common output port, wherein N≧1 where N is a constant;

a third switch having one end connected to the common output port and the other end connected to the first node;

M first input ports respectively connected to the other set of ends of the first switches; and N second input ports respectively connected to the other set of ends of the second switches, wherein one port selected among the first input ports and the second input ports is connected to the common output port, and if one of the first input ports is selected, the third switch is closed; and wherein each of the M first switches and each of the N second switches comprise at least two field effect transistors connected together in series.

2. The switching circuit of claim 1, wherein power of a frequency signal input to the second input port is higher than power of a frequency signal input to the first input port by at least 3 dB.

3. A switching circuit comprising:

one common output port;

M first switches having one set of ends connected in common to a first node, wherein M≧2where M is a constant;

N second switches having one set of ends connected in common to the common output port, wherein N≧1where N is a constant;

a third switch having one end connected to the common output port or the first node through a jumper wire and the other end connected to the first node or the common output port;

M first input ports respectively connected to the other set of ends of the first switches; and N second input ports respectively connected to the other set of ends of the second switches, wherein one port selected among the first input ports and the second input ports is connected to the common output port, and if one of the first input ports is selected, the third switch is closed.

4. The switching circuit of claim 3, wherein a length of the jumper wire is determined such that if one of the second input ports is selected, a resonant frequency caused by capacitance formed at the M first switches being open and inductance of the jumper wire becomes equal to a harmonic of a frequency signal applied to the selected second input port.

5. The switching circuit of claim 3, wherein a harmonic of a frequency signal applied to one of the second input ports is at least 2.5 times higher than the highest frequency of a frequency signal applied to another port.

6. The switch of claim 3, wherein the first to third switches each include a field effect transistor.

7. A switching circuit comprising:

one common output port;

M first switches having one set of ends connected in common to a first node, wherein M≧2where M is a constant;

N second switches having one set of ends connected in common to the common output port, wherein N≧1where N is a constant;

a third switch having one end connected to the common output port and the other end connected to the first node;

M first input ports respectively connected to the other set of ends of the first switches; and N second input ports respectively connected to the other set of ends of the second switches, wherein one port selected among the first input ports and the second input ports is connected to the common output port, and if one of the first input ports is selected, the third switch is closed; and wherein power of a frequency signal input to the second input port is higher than power of a frequency signal input to the first input port by at least 3 dB.

* * * * *

UNITED STATES PATENT AND TRADEMARK OFFICE

CERTIFICATE OF CORRECTION

PATENT NO. : 7,847,655 B2
APPLICATION NO. : 12/180870
DATED : December 7, 2010
INVENTOR(S) : Norihisa Otani et al.

It is certified that error appears in the above-identified patent and that said Letters Patent is hereby corrected as shown below:

On the title page, the Assignee should read as follows:

Item (73) Assignee: Samsung Electro-Mechanics Co., Ltd., Suwon (KR)

Signed and Sealed this
Fifteenth Day of March, 2011

David J. Kappos

David J. Kappos
*Director of the United States Patent and Trademark Office*